US006158742A

United States Patent [19]

Platt

[11] Patent Number: 6,158,742

[45] Date of Patent: Dec. 12, 2000

[54] VAMPIRE COUNT HIDE AND GO SEEK GAME

[76] Inventor: David Ersel Platt, 392 No. 900 E., Bountiful, Utah 84010

[21] Appl. No.: 09/228,549

[22] Filed: Jan. 10, 1999

Related U.S. Application Data

[60] Provisional application No. 60/071,352, Jan. 10, 1998.

[51] Int. Cl.[7] ..... A63F 1/00; A63F 9/00

[52] U.S. Cl. ..... 273/292; 273/308; 273/440

[58] Field of Search ..... 273/306, 292, 273/308, 440, 444, 454

[56] References Cited

U.S. PATENT DOCUMENTS

| | | | |
|---|---|---|---|
| 4,961,575 | 10/1990 | Perry | 273/454 |
| 5,011,156 | 4/1991 | LaChance, Jr. et al. | 273/237 |
| 5,662,332 | 9/1997 | Garfield | 273/308 |

OTHER PUBLICATIONS

"I Spy", Book Of 1000 Family Games, Reader's Digest Association, pp. 19–20, Jun. 1973.

"Sardines", The Way To Play, Diagram Group, Paddington Press, Ltd., p. 288, Mar. 1976.

*Primary Examiner*—Benjamin H. Layno

[57] ABSTRACT

This game is a hide and go seek type party game with many variations. The game can accommodate any number of desired participants. The game is suitable for individuals ages five to ninety years old. The rules and playing instructions are presented on cassette tape. The recording artist speaks with a "transylvania" type accent, the accent most commonly used in older vampire movies. As the rules are given and the game is played, special effect original audio music is heard in the background. (FIG. 27) The sounds of an organ, heavy rain mixed with explosive thunder and crashing cymbals add an additional aura of uncertainty for the newly invited guests. The game is played with twenty five individual playing cards each with a common backside (FIG. 1). Only one card is designated as the vampire card (FIG. 2). The game has twenty four victim cards, each with different names and various causes of death associated with vampires (FIGS. 3 to 26). Many participants who have come to play the game were invited by receiving a special invitation that was duplicated from the master copy of the invitation provided with the game. (FIG. 28)

1 Claim, 6 Drawing Sheets

AUDIO CASSETTE TAPE LABELS

LISTENING TO THIS CASSETTE IS MANDATORY

"VAMPIRE COUNT™"

GAME RULES AND MUSIC

SIDE ONE

BITE INC.™

JUST BY LISTENING TO THIS TAPE.

PLAYER SURVIVAL IS NOT GUARANTEED

© P 1998 BITE INCORPORATED

PO BOX 399 CENTERVILLE, UTAH 84014

REPRODUCTION IN ANY FORM IS UNLAWFUL

LISTENING TO THIS CASSETTE IS MANDATORY

"VAMPIRE COUNT™"

GAME BACKGROUND MUSIC

SIDE TWO

BITE INC.™

JUST BY LISTENING TO THIS TAPE.

PLAYER SURVIVAL IS NOT GUARANTEED

© P 1998 BITE INCORPORATED

PO BOX 399 CENTERVILLE, UTAH 84014

REPRODUCTION IN ANY FORM IS UNLAWFUL

FIG. 27

"VAMPIRE COUNT™" IS ONE OF THE THE ZANIEST GAMES YOU'LL EVER PLAY. EXPERIENCE LAUGHTER, ANXIETY, CALMNESS, PANIC, RELIEF, FRIGHT, APPREHENSION, ANTICIPATION, TREPIDATION, AND AMUSEMENT. YOU WILL SCREAM, REMAIN QUIET, FEEL SAFE, BE INSECURE, HOLD YOUR BREATH AND FEEL NERVOUS SHIVERS. YOU WILL BE ENTERTAINED AND HAVE AN UNBELIEVABLY FANTASTIC TIME WITH YOUR FRIENDS. YOU'LL TALK ABOUT THIS TIME "FOREVER".

*DON'T MISS THE FUN. RSVP NOW.*

*© 1998 BITE INC.™*

"VAMPIRE" "COUNT"

YOUR INVITATION TO ANXIETY AND LAUGHTER

COPYRIGHT ©1998 BITE INC

YOU'RE INVITED TO A

"VAMPIRE COUNT ™"

PARTY

DATE _____

TIME _____

PLACE _____

_____

HOSTED BY _____

HOW MANY WARM BODIES CAN WE COUNT ON ?

PLEASE CALL _____

*"DRESS CASUAL"*

A PARTY FRIENDS CAN REALLY SINK THEIR TEETH INTO !!! IF YOU'RE ANEMIC, DISREGARD THIS INVITATION.

fig. 28

VAMPIRE COUNT HIDE AND GO SEEK GAME

CROSS-REFERENCES TO RELATED APPLICATIONS

This application claims the benefit of provisional patent application serial No. 60/071,352 filed Jan. 10, 1998 patent pending #E1704412496U.S.

BACKGROUND

1. Field of Invention

This invention relates to group party games, specifically to a hide and go seek type game that is normally played with three to twenty five participants.

2. Description of Prior Art

After an in depth search of existing games, I can find no prior art directly germane to this invention.

This group game provides families and friends with hours of fun.

OBJECTS AND ADVANTAGES

Several objects and advantages of the present invention are:

(a) To provide a game where a special invitation is included with each game which can then be duplicated and used to invite potential participants.

(b) To provide a game for any size group, even though normally played with three to twenty five people, the game can accommodate any number of desired participants.

(c) To provide a game where participants can play together and be any combination of ages and enjoy each other's participation.

(d) To provide a game where game rules and regulations provide a hilarious method of play.

(e) To provide a game where the complete rules and style of play have been recorded on an audio cassette tape and recommends that all participants learn how to play the game by listening to the tape.

(f) To provide a game where original special effect music, recorded on audio cassette tape, is heard in the background, both during the explanation of the rules and while playing the game.

(g) To provide a game for participants, who at some time in their lives played a game of hide and go seek and loved the feelings they had while successfully hiding from someone searching for them, and would like to relive those feelings.

(h) To provide a game where as participants play this game their mind conjures up panicky, apprehensive feelings.

(i) To provide a game where an additional dimension is added by playing the game in total darkness and causes nervous tension to increase.

(j) To provide a game where participants while hiding in the dark, waiting to be found, can hear the blood curdling screams of other victims that have been located causing their apprehension and anxiety to mount.

(k) To provide a game where a single pretend vampire starts searching for victims, is successful, therefore creating a second vampire, now there are two, then three, then four, then more, all searching for those still hiding, resulting in a major adrenaline rush for those not yet located.

Further objects and advantages of my invention will become apparent from A consideration of the drawings and ensuing description of how to play the game.

DESCRIPTION OF DRAWINGS

The file of this patent contains at least one drawing executed in color. Copies of this patent with color drawing(s) will be provided by the Patent and Trademark Office upon request and payment of the necessary fee.

FIG. 27. Shows a copy of each side of the audio cassette tape labels.

FIG. 28. Vampire Count party invitation ready for copying and folding.

SUMMARY

This game incorporates a combination of rules that are unique to this specialized game. These rules prescribe the exact method of play to achieve an exact outcome. The game contains 25 playing cards with original art work. Included with this game is an audio cassette tape of specialized recorded rules and original music. A master copy of an invitation is included for inviting prospective participants.

DESCRIPTION OF INVENTION

This game is one of the zaniest games ever played. Participants will experience laughter, anxiety, calmness, panic, relief, fright, apprehension, anticipation, trepidation, and amusement. They will scream, remain quiet, feel safe, be insecure, hold their breath, and feel nervous shivers. They will be entertained and have an unbelievably fantastic time with their friends. They will talk about playing this game forever.

This game is a perfect party game for any size group and is normally played with three to twenty five people. More participants can play in the same game by adding additional victim cards from other sets of game cards. It is a game that allows individuals to intermingle and get acquainted. The game is suitable for individuals ages five to ninety years old. Children even younger, playing with their parents or older brothers and sisters have a great time playing.

The rules are presented on cassette tape. The recording artist speaks with a "transylvania" type accent, the accent commonly used in most older vampire movies. As the rules are being read, dramatic organ music, commonly associated with vampires, permeates the air. The sounds of heavy rain, mixed with explosive thunder and crashing cymbals add an additional aura of uncertainty for the newly invited guest players. The music continues to play while the actual game is played. (FIG. 27)

Figure 1:
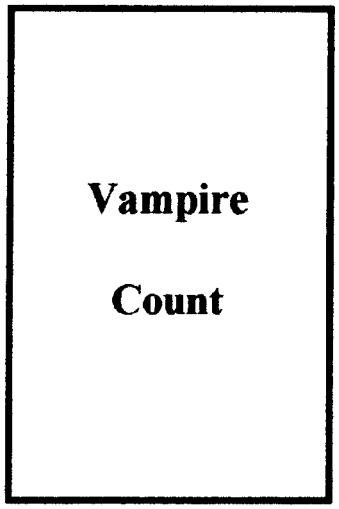
FIG. 1. Shows the back side artwork of all twenty five game playing cards.
Figure 2:
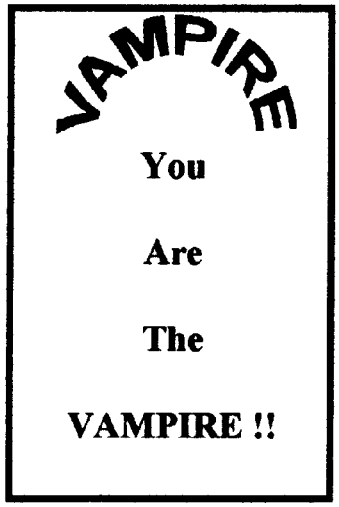
FIG. 2. Shows the vampire card, only one in each set of playing cards.
Figure 3:
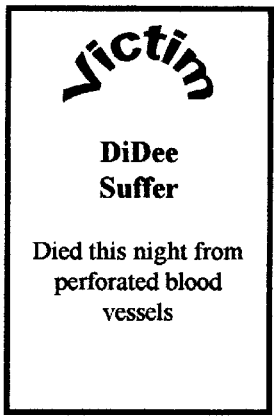
FIGS. 3. through 26. Shows the victim cards each card having a different victim's name, and includes their cause of death.
Figure 4:
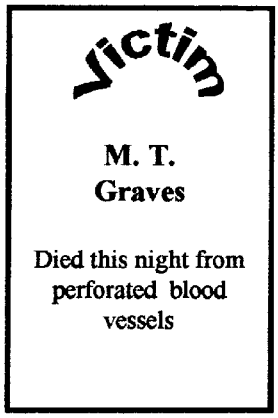
Figure 5:
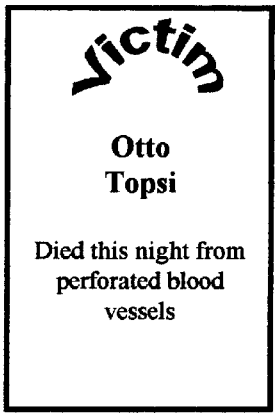
Figure 6:
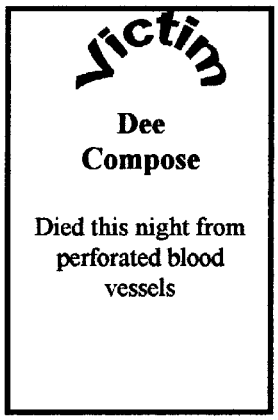
Figure 7:
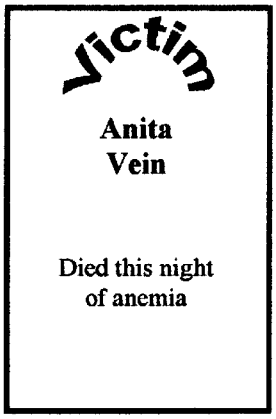
Figure 8:
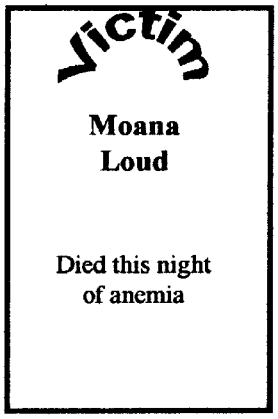
Figure 9:
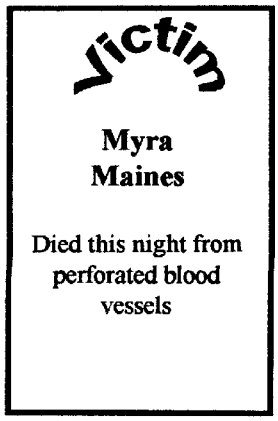
Figure 10:
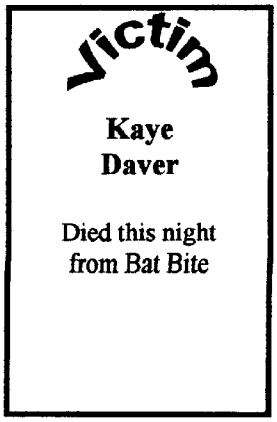
Figure 11:
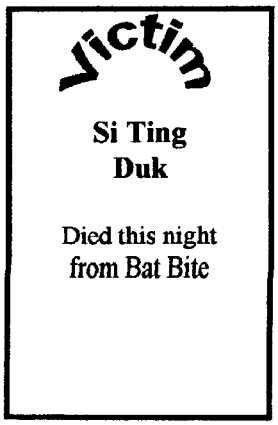
Figure 12:
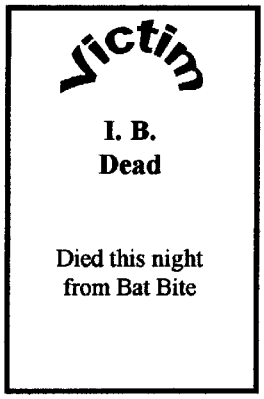
Figure 13:
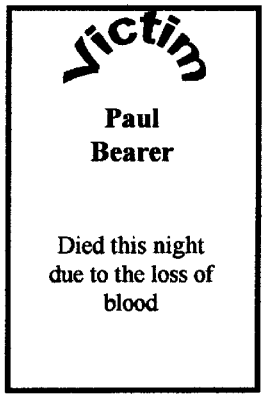
Figure 14:
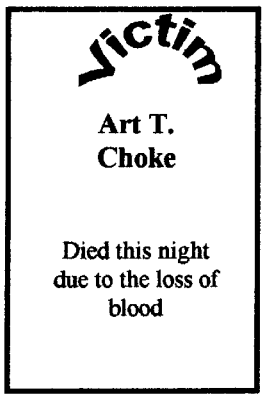
Figure 15:
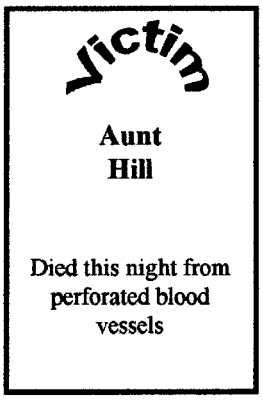
Figure 16:
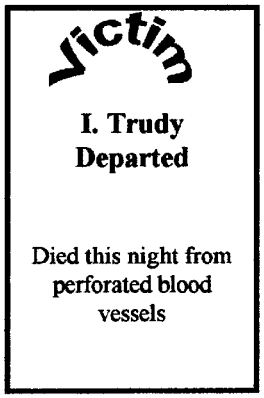
Figure 17:
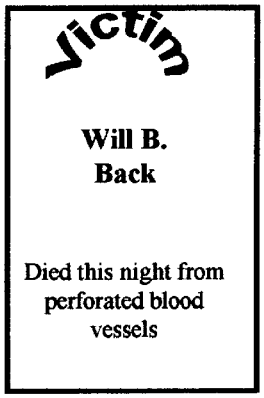
Figure 18:
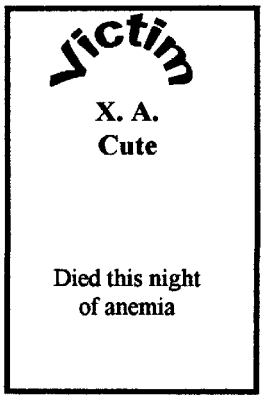
Figure 19:
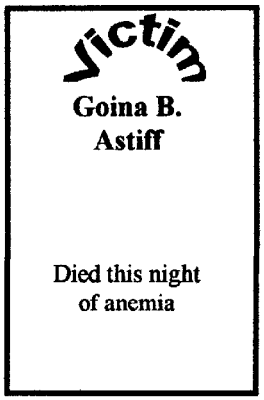
Figure 20:
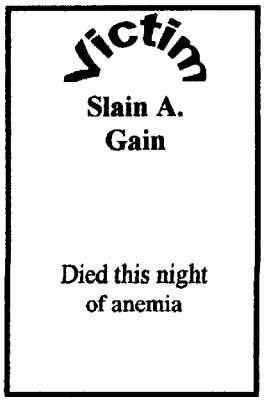
Figure 21:
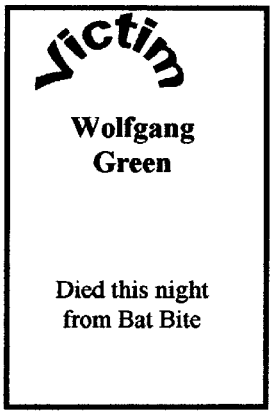
Figure 22:
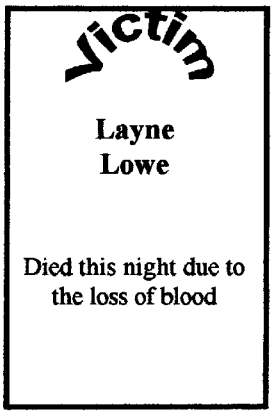
Figure 23:
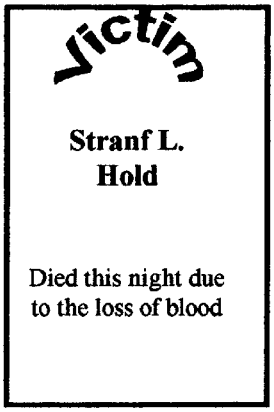
Figure 24:
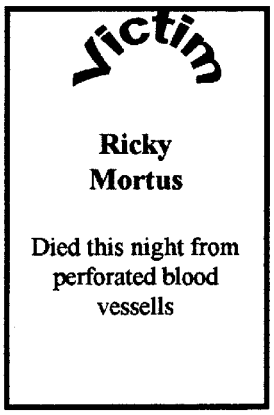
Figure 25:
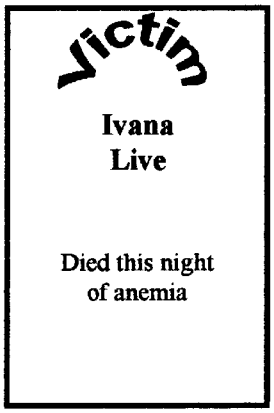
Figure 26:
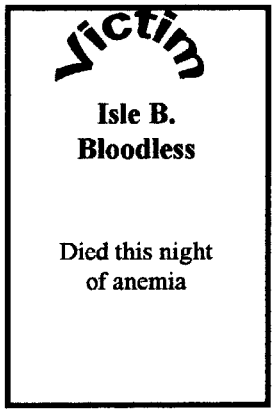

There are twenty five individual playing cards each with a common backside (FIG. 1). Only one card is designated as the vampire card (FIG. 2). The game has twenty four victim cards each with different names and various causes of death associated with vampires (FIGS. 3 through 26). Some participants who have come to play the game were invited by receiving a special invitation that was duplicated from the master copy of the invitation provided with the game. (FIG. 28)

OPERATION

Full instructions on how to play the game named Vampire Count are included with each game. The following is the exact dialog of rules and regulations as presented on the audio cassette and in the written rules.

Welcome to Vampire Count, a party game family and friends can really sink their teeth into! It is mandatory that all players give ear and pay close attention to the cassette tape of the Vampire Count rules. Should you choose to ignore this advice and simply read aloud the complete Vampire Count rules, there will be no guarantee of individual player survival.

Warning: if you are frail, suffer from extreme nervousness, have high blood pressure, a severe heart condition, or weakness of bladder, it is suggested you obtain approval from your physician before playing Vampire Count, those with pulsating red blood cells are ideal candidates. (if you're anemic, the vampire would just as soon you didn't play!) If you would like to withdraw, now is the time to make it known.

To start the game flowing, this is the vein we want to go down. All activities will be directed by the host. After the sun sets, gather together as many victims as you can round up. Three to twenty five victims, ages five to ninety five, will provide sufficient nourishment.

If victims are to fall prey to the vampire indoors, darken all areas in which Vampire Count is going to be played. Draw all drapes and blinds, turn off all night lights, and shut off all illuminated dials. If the vampire will be searching for victims in a backyard, park, woods, campground, cornfield or cemetery, play on a moonless or cloudy night.

Congregate all players together in a common area. Certify that the area is cleared of all garlic, silver bullets and wooden stakes. The host takes the group on a tour of the entire area or dwelling where the game is to be played. For personal safety all participants must stay close together. The host explains the exact boundaries. These boundaries outline a relatively safe haven for players to conceal themselves.

The major purpose of this tour is for players to note places in which to take refuge when they are offered a chance to hide from the vampire. All areas are established that are off limits and too dangerous to inhabit because of an infestation of werewolves, ghouls and night stalkers. Complete the tour and return to the common area.

The host now shuffles and mixes together the vampire count playing cards consisting of one vampire card (FIG. 2) and 24 victim cards (FIG. 3) the host is totally unaware of the location of the "vampire card" in the deck. Starting from left to right, the vampire count cards are now passed out, one at a time, until all cards have been handed out, including cards for the host.

Each participant carefully views their own cards, allowing no one else to see them. After viewing their cards, they discreetly return them to the host. Everyone now knows if they will be a victim or if they are to be the vampire. No one knows who the vampire is except the vampire.

The host now simply says, "Take refuge" and turns off the lights. Everyone, including the one who has drawn the vampire card, disperses to hiding places. Everyone hides separately. (your fate would be sealed if you hid with the vampire.)

When all players have hidden, they must stay in their selected place of refuge. Players can not change places or move around once they have hidden.

The game is over and must be started again if anyone turns on a light or uses a lantern or flashlight.

The vampire stays hidden for a brief period of time as he anticipates the thrill of the kill. In a few minutes he makes his move and begins the "Vampire Shuffle". The "Vampire Shuffle" consists of slowly sliding the feet across the floor while emitting a low moaning utterance of, "i vaunt to suck your blood!" This often causes a victim to cry out in uncontainable laughter, becoming easy prey for the vampire.

The vampire searches for victims everywhere in the darkness, under beds, on couches, under tables, in closets, behind bushes and trees, dark corners, and obscure tombstones.

When a victim is located he cannot struggle, run or put up any resistance. The victim must simply expose his neck and accept his fate.

The vampire simply places his or her hands gently around the victim's throat. When the vampire's hands are around the victim's throat the victim immediately emits the most bloodcurdling scream he is capable of producing. When a victim screams, he is immediately changed to a "Fellow bloodsucker". Now there are two vampires searching for a food source. Soon there are three, then four and then there are more.

When no new victims are being found, the head or initial vampire requests a "Vampire Count". All vampires return to the common area with the lights still off. The head vampire shouts 1. His converts, each in turn, continue the count 2,3,4,5,6,7 etc. If you started the game with 10 players and you only have 7 vampires you would know that you had 3 more warm bodies to find and would start searching again more carefully. As more victims are found, have additional vampire counts.

If the vampires are not successful in finding all available victims, the head vampire can call for a victim's "nervous cough" whereupon the still remaining victims immediately emit a loud "nervous (choke, choke) cough" to assist the searching vampires.

When all victims have been found and turned into vampires, everyone returns to the common area and congratulate the last victim found.

The player who drew the vampire card and became the head vampire in the previous game, is the host for the next game.

As you start the next game, do not pass out cards to those who have had nervous breakdowns or have died of fright! Discontinue all Vampire Count activities before sunrise!

The host will now take you on a tour of the playing area. All players arise. For your personal safety everyone must stay close together. The music will continue to play.

CONCLUSION

Accordingly, the reader can see that after hearing or reading the rules newly invited guests understand how the game is played. Interviews with those who have played the game have been extremely positive, for example:

I like to be scared. Especially when it's just playing in the dark and hiding from one of my friends who is a pretend vampire. Maria age 9

I love and hate this game. It scares the daylights out of me! I've never held my breath for so long. The vampire came near my hiding place without finding me. Maura June age 16

As a grandmother I like playing the game with my grandchildren. They love to hear me scream. It's great fun when the whole family gets together. Elaine R. age (old enough)

I think the cassette tape that explains how to play the game is hilarious. The vampire music is totally awesome. Jamie Lynn age 13

I hid with my best friend, what a traitor! He turned out to be the vampire Chrisy age 31

It's so easy to have a Vampire Count party. I handed out the invitations that came with the game and told everyone to bring dates. They all came. By the time the night was over everyone wanted to plan another party. Jon age 17

I like to be the vampire and I like hiding. Britain age 5

I like the scary feeling I get when I'm hiding and I hear the "Vampire Shuffle" begin. It gives me goose bumps. Ian Thomas age 8

RAMIFICATIONS

While my above description contains many specificities, these should not be construed as limiting the scope of the invention, but as merely providing illustrations of some of the presently preferred styles of this invention. For example: The playing card styles could be completely different. The vampire card could be a cartoon type vampire. The victim cards could have faces of different individuals and the various ways in which they died. The audio cassette tape of instructions could be played by a cassette recorder built into an animated toy size vampire. A video tape could be made of a vampire presenting the instructions. Various costumes could be worn by participants, including the host of the party dressing as a vampire. Instructions on how to plan a successful Vampire Count dinner party etc.

SCOPE

Thus the scope of the invention should be determined by the appended claims and their legal equivalents, rather than by the examples given.

I claim:

1. A method of playing a hide and go seek type party game comprising the steps of:

providing a deck of cards, each card having identical indicia on the back side making the back sides of all the cards visually indistinguishable from each other, said cards including victim cards, each victim card having indicia on the front side representing a person's name and a cause of death, said cards also including only one vampire card having indicia on the front side representing a vampire wherein the front side of the vampire card is clearly visually distinguishable from the front side of all of the victim cards;

congregating all players together in a common illuminated area capable of being darkened on command, said area having a plurality of places where each player can hide separately;

shuffling the deck of cards;

dealing the cards one at a time to each player until all of the cards have been dealt out;

each player individually viewing their own cards, each player allowing no one else to see their cards, players receiving only victim cards secretly assigning themselves as victims, and the one player receiving the vampire card secretly assigning himself/herself as a initial vampire, and no player knowing who the initial vampire is except for the player assigned as the initial vampire;

returning the cards to the deck;

darkening the common area reducing visibility in the common area;

all the players including the player assigned as the initial vampire dispersing and finding places to hide in the common area, each player hiding in separate places, wherein each player not knowing or not recognizing where each of the other players are hiding because of the reduced visibility;

after all the player having stayed hidden for a brief period of time, the player assigned as the initial vampire, moving out of his/her hiding place and begins searching for the other hidden players or victims;

when the initial vampire finds a victim, the initial vampire converting the found victim into a vampire, and the newly converted vampire helping the initial vampire in searching for the remaining hidden victims, wherein the newly converted vampire also having the power to convert found victims into vampires;

said vampires continuing to search for victims, and converting found victims until all victims are found.

* * * * *